US005812160A

United States Patent [19]

Wada et al.

[11] Patent Number: 5,812,160

[45] Date of Patent: Sep. 22, 1998

[54] IMAGE FORMING APPARATUS WITH IMPROVED ASSEMBLIES FOR TORE CARRIER, TONER PASSAGE CONTROL DEVICE AND BACKING ELECTRODE

[75] Inventors: Takasumi Wada; Masayuki Tone; Keiji Itsukushima; Hidemasa Aiba, all of Tokyo, Japan; Ove Larson, Goeteborg, Sweden

[73] Assignees: Kyocera Corporation, Kyoto, Japan; Array Printers AB, Molndal, Sweden

[21] Appl. No.: 734,100

[22] Filed: Oct. 21, 1996

Related U.S. Application Data

[63] Continuation of Ser. No. 304,421, Sep. 12, 1994, abandoned, which is a continuation of Ser. No. 617,900, Nov. 26, 1990, abandoned.

[30] Foreign Application Priority Data

Nov. 29, 1989 [JP] Japan ..... 1-309545
Nov. 29, 1989 [JP] Japan ..... 1-309546

[51] Int. Cl.[6] ..... B41J 2/06; B41J 25/308

[52] U.S. Cl. ..... 347/55; 347/8

[58] Field of Search ..... 347/8, 55, 104, 347/112, 111, 141; 400/605, 619, 642; 399/310, 316, 317

[56] References Cited

U.S. PATENT DOCUMENTS

| | | | |
|---|---|---|---|
| 3,853,397 | 12/1974 | Cantarano | 355/265 |
| 4,179,210 | 12/1979 | Bestenreiner et al. | 355/256 |
| 4,197,023 | 4/1980 | De Boo et al. | 400/642 X |
| 4,463,361 | 7/1984 | Koumura et al. | 346/134 |
| 4,478,510 | 10/1984 | Fujii et al. | 346/159 |
| 4,480,907 | 11/1984 | Vackier | 355/256 |
| 4,491,855 | 1/1985 | Fujii et al. | 346/159 |
| 4,610,531 | 9/1986 | Hayashi et al. | 355/246 |
| 4,717,926 | 1/1988 | Hotomi | 346/140 R |
| 4,761,663 | 8/1988 | Piatt et al. | 346/134 |
| 4,795,282 | 1/1989 | Bradam | 400/605 |
| 4,843,338 | 6/1989 | Rasmussen et al. | 346/140 R |
| 4,849,772 | 7/1989 | Ten Broeck et al. | 346/134 X |
| 4,868,600 | 9/1989 | Hays et al. | 355/259 |
| 4,930,438 | 6/1990 | Demizu et al. | 118/651 |
| 4,934,850 | 6/1990 | Okubo et al. | 400/662 X |
| 4,943,818 | 7/1990 | Hotomi | 346/140 R |
| 4,962,723 | 10/1990 | Hotomi | 118/654 |
| 4,992,805 | 2/1991 | Yoshizawa et al. | 346/134 |
| 5,036,341 | 7/1991 | Larsson | 346/154 |
| 5,065,169 | 11/1991 | Vincent et al. | 346/140 R |
| 5,374,949 | 12/1994 | Wada et al. | 347/112 |
| 5,446,478 | 8/1995 | Larson | 347/55 X |

FOREIGN PATENT DOCUMENTS

| | | | |
|---|---|---|---|
| 0152976 | 9/1982 | Japan | 400/56 |
| 89 02 0911 | 12/1990 | Sweden . | |
| WO 90 14959 | 12/1990 | WIPO . | |
| WO 91 04863 | 4/1991 | WIPO . | |

*Primary Examiner*—Benjamin R. Fuller
*Assistant Examiner*—Charles Dickens
*Attorney, Agent, or Firm*—Loeb & Loeb

[57] ABSTRACT

An apparatus for printing directly on plain paper, utilizing an arrayed control grid having a plurality of toner slots disposed in a space between a toner carrier and a backing electrode on which a paper travels. The backing electrode formed in a flat plate facing paralleledly to the control grid assures a uniform electrostatic field in an interspace therebetween. A unit body associated with the toner carrier and the control grid makes the interspace open when the unit body is removed from the apparatus body which offers an easy access to the interspace and the members as well. A resiliently suspended backing electrode with a spacer, a restriction member etc., assures the interspace constant. Other unit bodies including the control grid associated with the backing electrode and others are also disclosed.

19 Claims, 5 Drawing Sheets

IMAGE FORMING APPARATUS WITH IMPROVED ASSEMBLIES FOR TORE CARRIER, TONER PASSAGE CONTROL DEVICE AND BACKING ELECTRODE

This is a continuation of application Ser. No. 08/304,421 filed on Sep. 12, 1994, now abandoned, which in turn is a continuation of application Ser. No. 07/617,900, filed Nov. 26, 1990, now abandoned.

BACKGROUND OF THE INVENTION

1. Field of the Invention

The present invention relates to an image forming apparatus formed in a manner that toner image is attracted directly on a recording sheet or a plane paper without utilizing a photosensitive drum or other latent image carrier, and more particularly to an image forming apparatus and a unit body employed therein having a toner carrier and a backing electrode on which surface the recording sheet is movable. The backing electrode is disposed to face to the toner carrier. The unit body may also include means for toner passage disposed to the toner carrier and the backing electrode. The means for toner passage is consisted has a plurality of arrayed toner slots adapted to electromagnetically open and close the toner passage along desired directions.

2. Description of the Prior Art

An electrophotographic apparatus is well known as a component used in printers and copying machines. A typical electrophotographic process involves imprinting an electrostatic latent image on a photosensitive drum, developing the electrostatic latent image by applying a developing agent of single or two components, and transferring the visible developed image to a record surface such as a sheet of paper.

As far as the electrophotographic apparatus is based on the process of transferring the toner image on the recording sheet by means of the photosensitive drum, it involves, beside the photosensitive drum for carrying the electrostatic latent image, means for imprinting the latent image on the drum, means for transferring the toner image borne on the drum, means for cleaning the residual toner particles attached on the drum, means for erasing the latent image, and means for recharging such as a corona discharge device. As a result, a large number of such devices have to be arranged about the drum to perform their intended functions. This results in an undesirably large apparatus having a complicated structure.

An image forming apparatus to overcome the drawbacks above is disclosed in the U.S. Pat. Nos. 4,478,510 and 4,491,855 and U.K. Pat. Application GB 2 108 432A (referred as 'the first prior technique' hereinafter), having means for toner passage, arrayed with one or two rows of toner slots effectable to open or close electromagnetically, arranged orthogonally (of which direction is referred as 'scanning direction' hereinafter) to the direction of the movement of a recording member movable on a backing electrode (of which direction is referred as 'subscanning direction' hereinafter), disposed between the backing electrode and a development roller which carries toner, in which a signal voltage corresponding to image information is applied to the means for toner passage to open selectively the toner slots during the movement of the recording member on the backing electrode, to transfer the toner borne on the surface of the toner carrier to the recording member through the toner slots.

The first prior technique, however, includes some restrictions for finer resolution (or printing dots density) which requires a more dense array of the slots, which issues other mechanical and manufacturing tasks.

A technique to resolve the drawbacks above is disclosed in the PCT/SE88/00653 or International Publication No. WO89/05231 (referred as the basic technique hereinafter).

FIG. 7 of the drawings showing a principle of the basic technique which comprises a toner carrier 1 including a sleeve-like development roller electromagnetically carrying toner in a thin layer thereon, a control grid 3 arranged in a matrix and disposed between the toner carrier 1 and a backing electrode 2 to oppose thereof, wherein the control grid 3 is applied with a control voltage in the direction of X-Y axes to form a developing electric field corresponding to an image information, which selectively opens or closes toner slots 3*a* in the control grid 3, causing the transfer of toner corresponding to the image information through the toner slot 3*a* in the control grid 3 on the recording paper 4 arranged on the surface of the backing electrode 2. Though the basic technique resembles the first prior art in the view point above, the basic technique especially forms the control grid 3, as shown in FIG. 8(*a*), in a matrix of a plurality of X-axis loop wires X1–X2, . . . of which paired wires are formed in a loop arrange d in a direction of the main scanning direction (X), and of a plurality of Y-axis paired loop wires Ya1–Ya2, . . ., wherein the two groups of the paired loop wires are arranged to intersect each other at an angle other than right angle, forming the portions surrounded by the paired loop wires Ya1–Ya2 on Y-axis and X1–X2 on X-axis as the toner slots 3*a*.

A voltage is successively applied to the wires X1–X, . . . with a time delay between successive voltage applications in synchronism with the movement of the recording paper 4. As a result, toner passing through the toner slots 3*a* in rows forms a dense dot patten without the necessity of densely arranging the interval between the wires Ya1–Y2a, . . ., or the interval of the toner slots 3*a* with respect to the scanning direction There reveals, however, a lot of issues to realize a practical use in the first prior art and the basic technique as well.

The first issue lies in conveying the recording paper.

The toner image borne on the recording paper 4 which has been passed through the space between the control grid 3 and the backing electrode 2 is not fixed yet. Even a slight touch of the recording paper 4 with the control grid 3, therefore, causes a disturbance of the toner image which has not be fixed yet.

To resolve the issue, the interspace between the recording paper 4 and the control grid 3 may be brought wider. But the basic technique relies on to form the developing electric field in the tight space of a few hundreds micron meters, for example, between the toner carrier 1 and the backing electrode 2. Further to the above, a further space has to be provided in the tight space to accommodate some thickness of the control grid 3 and the toner layer on the toner carrier 1. As a consequence, the interspace left for conveying the paper between the control grid 3 and the backing electrode 2 is limited to a remaining 100 to 300 micron meters. It is very difficult to convey the recording paper 4 in the tight space without the paper touching the control grid 3.

The second issue lies in the jamming of paper in the space.

Recording papers are apt to curl particularly at the edge under the influence of humid air. In the event when the curled paper enters into the tight space, it not only touches with the control grid 3, but also jams in the space bringing the extrication difficult or impossible. Once it happens, an attempt to remove the paper from the space at an entrance or exit thereof may destroy the control grid 3 formed in a thin plate or meshed sieves.

Hence, in the first prior technique and the basic technique, the backing electrode is formed in a roller member of which peripheral surface conveys the recording paper 4 thereon. In the constitution above, the two roller members, i.e., the development sleeve acting as a toner carrier and the backing electrode 2, face each other. This results in a bigger equipment and fluctuation of the development space due to a poor alignment and a lack of perfect roundness of the roller members.

Furthermore, when the cylindrical backing electrode 2 is not positioned in parallel with the flat control grid 3 it is difficult to form a uniform development field, and hence, a clean image, too.

The third issue lies on clogging of toner at the control grid.

The toner slot 3*a* in the control grid 3 is so small so that the toner slot may easily be clogged with toner. Removal of the clogged toner is troublesome as the control grid 3 is, as described above, disposed in the tight space between the backing electrode 2 and the toner carrier 1.

The fourth issue is the maintenance of the accurate space interval.

Upon the fluctuation of the space interval between the members as well as the interspace for the development field, and in particular the interspace between the control grid 3 and the recording paper 4, the diameter of the toner dot adhered to the recording paper 4 which leads to the failure in forming a clean image. In spite of the need for keeping accurately the space interval, there are such problems as a floating and a meandering of the recording paper itself, and a disturbance of the image, because the toner image is not fixed yet, if the recording paper was attempted to be held by means of a spacer contacting therewith to keep accurately t he space interval. Even if the edges of the recording paper at the marginal sides orthogonal to the convey direction thereof were to be held to control the space interval, the effort will result in failing to control a floating at the middle part of broader sized paper.

SUMMARY OF THE INVENTION

Considering the drawbacks of the basic technique above, an object of the present invention is to provide an image forming apparatus wherein the space for development field in particular the interspace between a control grid 3 and a recording paper 4 is accurately controlled, and wherein a recording paper passes without touching the control grid 3, thus enabling the apparatus to obtain fine resolution and clear image formation.

It is another object of the present invention to provide an image forming apparatus and a unit body employed therefor, intended to offer easy maintenance in particular for jamming.

It is still another object of the present invention to provide an image forming apparatus and a unit body employed therefor, with easy alteration of coloring and easy replacement of consumables.

It is yet another object of the present invention to provide an image forming apparatus which accurately controls a space interval without any floating nor meandering of a recording paper, and without any disturbance of the image.

The present invention will become fully apparent from the following detailed description. The expression appearing in the claims as 'means for toner passage to form toner slots corresponding to the image information with controlling electric potential' may be generally interpreted as a control grid formed of FPC or wire electrodes, which is not to be necessarily limited to the interpretation, but includes means performing the features of the above, for example, of an arrangement of a plurality of electrodes arranged in parallel with a desired space crossing each other. The term 'the control grid' is used illustratively to express 'the means for toner passage' hereinafter.

The term 'a recording sheet' as stated in the claims is not necessarily limited to a recording paper, but includes, for example, a plastic sheet. The term 'a recording paper' is used collectively to express illustratively the term 'a recording sheet' above.

The invention as claimed in claim 1 features firstly to form a backing electrode 2 in a flat plate, instead of forming in the cylindrical roller as is in the basic technique, and to dispose the backing electrode 2 in paralleled with a control grid 3 with an interspace 11 therebetween having a desired interval.

Despite of formation of the stable development field in the interspace 11 between the control grid 3 and the backing electrode 2 with a desired interval, it is perplexing to insert the recording paper in the interspace 11 of the constitution above.

Thus, the second feature as claimed in claim 1 lies to provide an entrance space 12 in front of the interspace 11, and to provide a spacer 13 at the entrance space 12 which brings a surface near the control grid 3 toward the backing electrode 2 to form an inlet interspace 13*a*.

The constitution above enables to insert accurately the recording paper 4 into the interspace 11 guided with the entrance space 13, and to form stably a toner image on the recording paper 4 without any accidental touch on the control grid 3, because the inlet interspace 13*a* in the entrance space 12 near the control grid 3 is brought from the control grid 3 toward the backing electrode 2.

The interval between the control grid 3 and the inlet interspace 13*a* is so narrow as to produce a discharge or a leak, and eventually to distort a clean image formation, if the spacer 13 which forms the inlet interspace 13*a* was made of conductive material. It is, therefore, preferable to form the spacer 13 of dielectric material.

Though the constitution above allows the stable entrance of the recording paper 4 into the interspace 11 without any touch with the control grid 3, there needs to convey the recording paper 4 with no floating nor other undesirable incidents. It is surmisable that a thickness variation of the recording paper 4 as its nature of a plane paper, of which variation gives a fluctuation of the space intervals between the control grid 3 and the recording paper 4, and in the worst case, gives the paper a touch with the control grid 3.

Then, the invention as claimed in claim 3 is aimed to keep the space interval between the control grid 3 and the recording paper 4 constant, and to form the space interval between the control grid 3 and the backing electrode 2 controllable to absorb the variation of the paper thickness. Hence, the first feature of the invention lies on to provide a marginal spacer 5 at least on the control grid 3 attachable with the recording paper 4 which allows stable convey without any floating of the recording paper 4.

The second feature of the invention as claimed in claim 3 lies on to form the backing electrode 2 facing to the marginal spacer 5 whose position is resiliently maintained with a restriction member 36 therebetween, which allows the variation of paper thickness to keep the space interval between the control grid 3 and the recording paper 4 constant.

The invention is not limited to the flat interspace 11 between the control grid 3 and the backing electrode 2, but also includes a convex interspace between the curved backing electrode 2 and the control grid 3 associated with the form of toner carrier 1.

It is preferable to make the surface of the backing electrode with an insulating material to prevent a leak to the recording paper 4 contacting directly therewith, and with an Almite coating or of fluoro-resin thereon to ensure an uninterrupted movement of the recording paper 4.

Since the interspace 11 between the backing electrode 2 and the control grid is so narrow that the front end of the recording paper 4 is easy to contact with the control grid 3 due to the vibration induced by the motion of the roller members at the entrance, resulting in a distortion of the toner image and other unintended incidents.

The present invention gives attention to the direction of the recording paper 4 entering into the interspace 11 to solve the drawbacks above. If the recording paper is inserted along the extension line of the backing electrode 2, it may contact with the control grid 3 due to the vibration of the front end of recording paper. It is also hazardous to insert it in the upward direction from the side of backing electrode 2 since the paper may directly hit the control grid 3.

The invention described in claim 6 features firstly to set the insert direction of the recording paper 4 putting the tail end of the recording paper 4 toward the side of control grid 3 above the extension line of backing electrode 2, so that the front end of recording paper 4 should contact with the backing electrode 2.

The second feature of the invention lies in to form the surface of backing electrode 2 with a less frictional and insulating material which allows smooth movement of recording paper 4 on the surface of backing electrode 2, and prevents a leak between the backing electrode 2 and the recording paper 4.

In the constitution above in which a toner image is directly deposited on a plain paper, a toner dot may not steadily be formed on the paper due to a repulsive force induced by a triboelectric charge generated by friction with roller members and so forth.

Hence to solve the drawback, the invention stated in claim 7 features to rid a paper of a charge of electricity by means for discharge 6*a* disposed on the convey line at the upstream of the backing electrode 2.

It is also indispensable to relieve of a charge on the paper until an unfixed toner image reaches to a fixing unit. Thus, the invention claimed in claim 8 features to provide means for discharge on a paper convey line at each side of upstream 6*a* and downstream 7*a* of the backing electrode 2.

Despite the constitution above, the control grid and the backing electrode are disposed fundamentally in a narrow space which is easily jammed resulting in a bothersome extrication. To replace the toner carrier and the control grid with another coloring or with a new one, it is very hard to rearrange those members with accurate alignment, if the replacement is done individually for each member one after the other.

Thus, the invention claimed in claim 9 features to form the toner carrier 1 and the control grid 3 into a single unit 10A which is removable from, and lodgeable into the apparatus body in the direction apart from, and to the backing electrode 2.

Since the toner carrier 1 and the control grid 3 have to be changed in every occasion for alternation of coloring, those members are incorporated in one unit to secure accuracy. The backing electrode, on the other hand, of which surface acts as a part of convey line of paper, is fixed on the apparatus body. Hence, those members are separative each other effectable to subject the convey line to an open space.

In the constitution above, the space in which the recording paper inserted becomes open, wherein the open space offers an easy access to release jamming. The constitution further offers a great advantage not to damage the control grid 3 due to jammed paper, because the the unit body 10A is removed apart from the backing electrode in the direction transverse to the backing electrode 2. If the unit body 10A is moved for removal in parallel with the control grid 3, instead, the jammed paper may rub the backing electrode 2 and harm the control grid 3.

Once the unit body 10A is removed from the apparatus, the surfaces of the control grid 3 and the backing electrode appear visible, which offers an easy remedy for jamming, and even for cleaning of the clogged toner slots 3*a* of the control grid 3.

There is a toner carrier 1 above the control grid 3, and the unit body includes the toner carrier 1 and forms a toner container as well. Hence, the unit body weighs considerably, and is apt to soil the control grid 3 and the backing electrode 2 with toner which may drop from the toner carrier 1 due to a shock caused during lodging the unit body 10A into the apparatus.

Thus, the invention claimed in claim 10 features an interval of the interspace between the unit body 10A and the backing electrode 2 is maintainable resiliently with means for positioning 5.

As the backing electrode 2 and the unit body 10A faces each other with the means for positioning 5 inserted therebetween, the interval of interspace between the unit body 10A and the backing electrode 2 is spontaneously kept accurately when the unit body 10A is merely lodged into the apparatus. And the unit body 10A is able to be lodged without shock through the resilient member. All the drawbacks above, thus, have been solved. Adding further to the above, the existence of the resilient member liberate an overload and abrasion which assures a long period of life of the means for positioning 5.

The control grid 3, as described above, is made in a form of meshed sieve or thin plate and has looped wires which may be easily broken due to the wedge action of jammed paper or other hazerdous treat. The control grid 3 alone, therefore, may be formed replaceable. It is, however, difficult to keep accurately the intervals between the control grid 3 and the toner carrier 1 or the backing electrode 2, due to machining and assembling deviations, failing to obtain a clear image.

One of the solutions is the unit body 10A, as described earlier, comprising the control grid 3 and the toner carrier 1. The other one is a unit body 50, an embodiment of the invention claimed in claim 11, comprising the control grid 3 and the backing electrode 2 which achieves at a relatively reasonable cost. The unit body 50 is lodgeable to and removable from the apparatus in the direction to and apart from the toner carrier 1. The advantage of the constitution of the latter are as follow:

The unit body 50 is a n assembly of the backing electrode 2 made merely of electrically conductive flat members and the control grid 3 made in the simple form of meshed sieve or thin plate with the reasonable cost which is tolerable to replace a damaged unit with a new one therewithal. The unit body 50, further, is effectable to assure the interval between the control grid 3 and the backing electrode 2 which is required the most severe accuracy. The unit body 50 is so constructed as to be lodgeable in and removable from the apparatus in the direction to and apart from the toner carrier 1 that the interval between the control grid 3 and the toner carrier 1 or a support member thereof is easily obtainable its accuracy.

The toner carrier 1, incidentally, does not necessarily be fixed in the apparatus, but may be arranged in an exchangeable form to fulfill the requirement of coloring and others, which is naturally included in the technical category of the present invention.

To accommodate a more severe accuracy of the intervals, the three members, i.e., the toner carrier 1, the control grid 3 and the backing electrode 2, are preferably associated in a unit body 60, as stated in claim 13. The unit body 60 is removable in the directions orthogonal to the paper convey line, i.e., a vertical way and a front and rear way taking the direction of convey line as a left and right way, so that the unit body 60 does not disturb the members disposed on the convey line.

The invention claimed in claim 14 is related especially to the unit body 50, 60 which is associated at least two members including the control grid 3 among the toner carrier 1, the backing electrode 2 and the control grid 3, wherein the unit body 50, 60 is removable from, and is lodgeable into the apparatus in a direction orthogonal to the paper convey line along a guide member 52*a*, 61*b*. The guide member 52*a*, 61*b* offers additional advantage to dispose accurately the unit body in the apparatus with a desirable orientation and position.

The apparatus body 61 is disposed with resilient means 63 ensuring a soft settle of the unit body 60, whereby the drawbacks due to a shock, as appeared in the unit body 10A, are eliminated.

The invention claimed in claim 16 features to provide an inlet interspace 13*a* at an entrance for the recording paper with an interval narrower than that of the interspace between the control grid 3 and the backing electrode 2, and preferably slightly thicker than a thickness of the recording paper, wherein the inlet interspace 13*a* is disposed closer to the backing electrode 2, rather than to the means for toner passage 3, more preferably, on a plane leveling closely to the top of backing electrode 2 in order to prevent a floating and a meandering of the recording paper, and to provide an image forming apparatus controllable accurately an interspace interval between the control grid and the recording paper to form a toner image without any distortion.

Since the technical means above suppress the recording paper 4 not to float over a full width when it enters into the image forming area, the recording paper 4 travels steadily without any floating at the mid portion of paper nor meandering with a simple means for suppression at the marginal both ends of paper.

As the entrance spacer 13 is provided at the entrance prior to the image forming, a touch of entrance spacer with the recording paper causes no toner image distortion. The location of the inlet interspace leveling with the backing electrode furthermore promotes the advantages above.

BRIEF DESCRIPTION OF THE DRAWINGS

FIGS. 1 to 6 relate to an image forming apparatus according to the embodiment of the present invention in which FIG. 1 is a schematic section view showing whole members of the apparatus;

FIG. 2 is a cross sectional view showing an image forming device which is a main part of the apparatus; and FIGS. 3 and 4 relate to an image forming apparatus according to another embodiment of the present invention in which FIG. 3 is a schematic section view showing an axis end of the apparatus;

FIG. 4 is a cross section view along A–A' in FIG. 3; and

FIGS. 5 and 6 are schematic section views showing respectively an axis end of image forming apparatus according to still other embodiments of the present invention claimed in claims 11 and 13.

FIGS. 7 and 8 relate to the basic technique applicable to the present invention in which FIG. 7 is an illustration showing principal members; and FIGS. 8(*a*) and 8(*b*) relate to the control grid in which FIG. 8(*a*) is an illustration showing a wiring array of the X-Y axes loop wires, and FIG. 8(*b*) is a wave form chart showing the control signals.

DETAILED DESCRIPTION OF THE PREFERRED EMBODIMENT

The preferred embodiments of the present invention will be described in detail with reference to the accompanying drawings. However, the sizes, materials, shapes, and relative arrangement of parts stated in the embodiments are not intended to restrict the scope of the present invention but are merely illustrative examples, unless otherwise specified.

Figure 1:
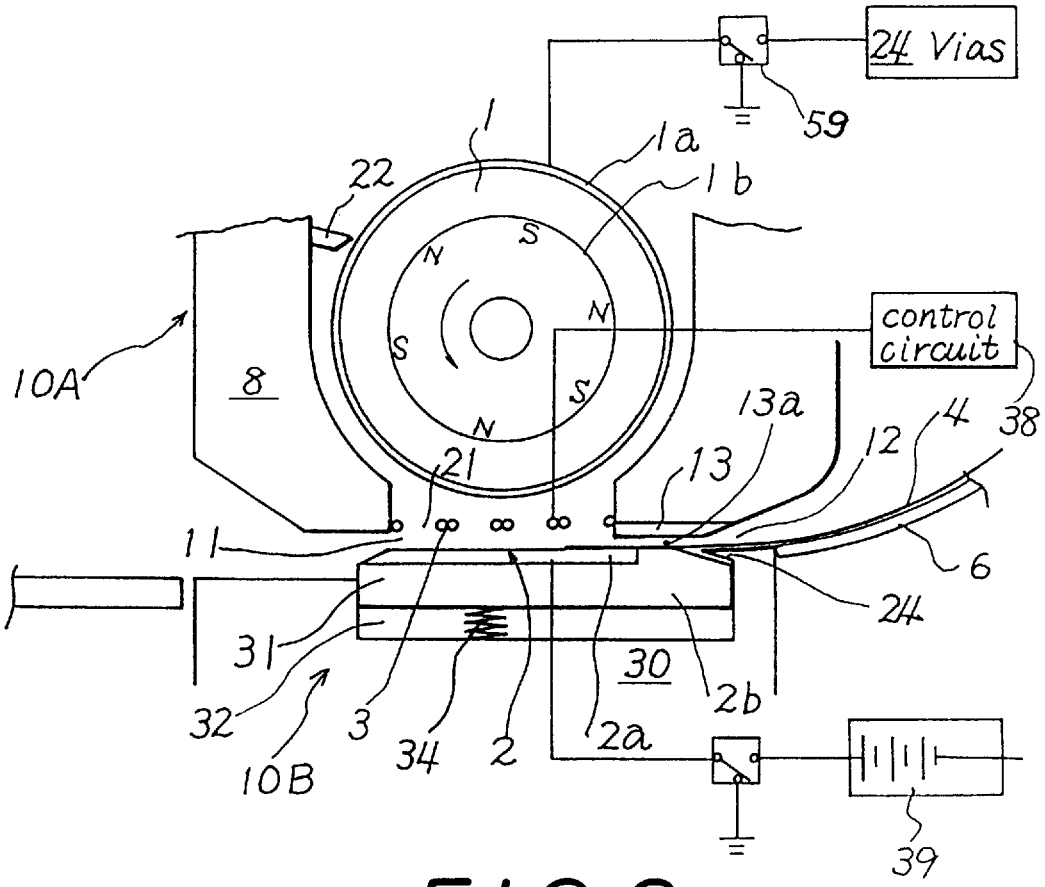
Figure 2:
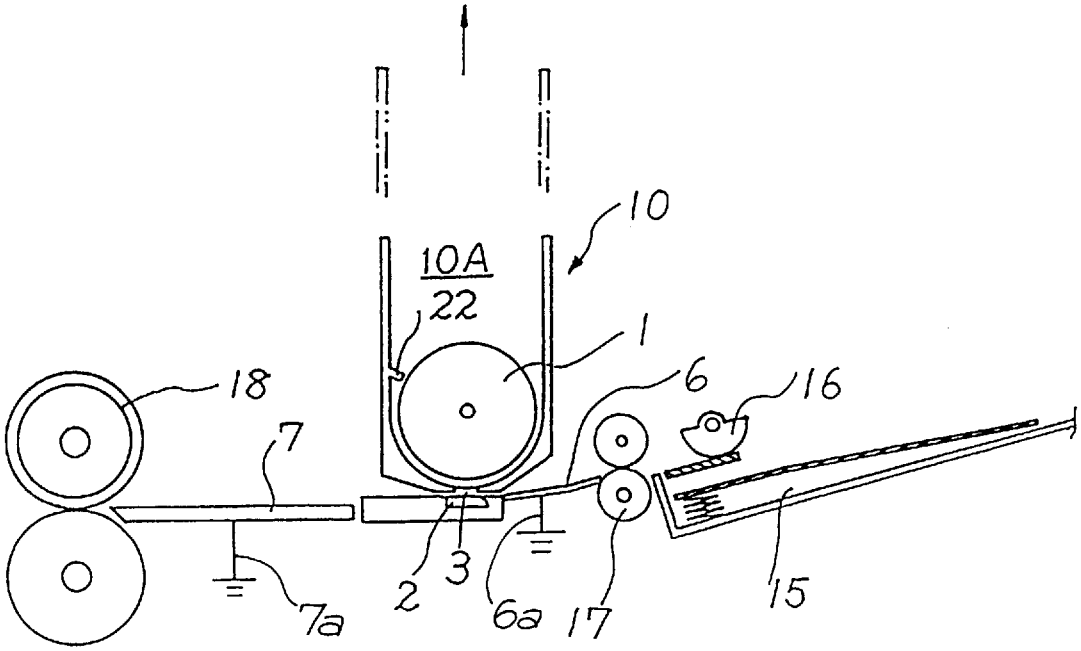

FIG. 2 is a schematic section view showing whole members of an image forming apparatus according to an embodiment of the present invention. The apparatus comprises means for paper feed consisting of a paper cassette 15 and a feed roller 16 disposed along a recording paper convey line, register rollers 17, an inlet guide 6, an image forming unit 10 illustrated in FIG. 1 in detail, a convey guide 7, and a pair of fixing rollers 18, wherein a recording paper 4 in the paper cassette 15 is fed by the feed roller 16, and pauses before entering into the image forming unit 10 through the inlet guide 6 with a timing of electrical control for a control grid 3. The inlet guide 6 is made of conductive material which is grounded through means for ground 6*a* to remove the charge formed triboelectrically with the register roller 17 etc., and of which tail end is bent convex slightly so that the front end of the recording paper 4 will slide steadily on the surface of a backing electrode 2 in the image forming unit 10.

The recording paper 4 bearing an unfixed toner image thereon which is formed by the image forming unit 10 corresponding to the image information of which detail will be described later enters through the convey guide 7 into the fixing roller pair 18 to be fixed the toner image.

The convey guide 7 is made of flat conductive materials, and is also grounded through means for ground 7*a* as well as the inlet guide 6 is grounded, to remove the charge of paper received during the process of image forming before entering into the fixing rollers 18.

The image forming device 10 consists of a unit body 10A being removable from, and lodgeable into the apparatus, and a backing electrode 2 disposed on an apparatus body 10B facing the unit body 10A. The unit body 10A comprises a toner container 8 with a long and narrow opening 21 at the bottom extending axially, a development roller or toner carrier 1 disposed in the toner container 8 opposing to the opening 21, and the control grid 3 stretched near the bottom of the toner container 8, wherein the members are formed in a single unit mechanically assembled or rotatably supported, whereby the unit 10A is vertically removable apart the backing electrode 2.

Referring to FIG. 1 of the drawings, there is illustrated a detailed sectional view of the image forming device 10. The toner container 8 containing single component magnetic toner has a doctor blade 22 therein facing to the development roller 1. A spacer 13 formed in a thin knife edge like is disposed at the bottom of the toner container 8 next to the opening 21 at the paper inlet side over a full width of the recording paper 4, whereby the recording paper 4 is guided its pass. The paper inlet or entrance 13*a* is defined by a lower guide wall 2*c* which is a portion of the top surface of the backing electrode 31 outside and adjacent to the toner passage control grid 3, and an upper guide surface 13*b* which is a portion of the bottom surface of the entrance spacer 13. The bottom edge of upstream side of the entrance spacer 13 is rounded outwardly to form a funnel-like entrance space 12 together with the inlet guide 6 of which the space gradually narrows towards the entrance of the entrance spacer 13.

Figure 3:
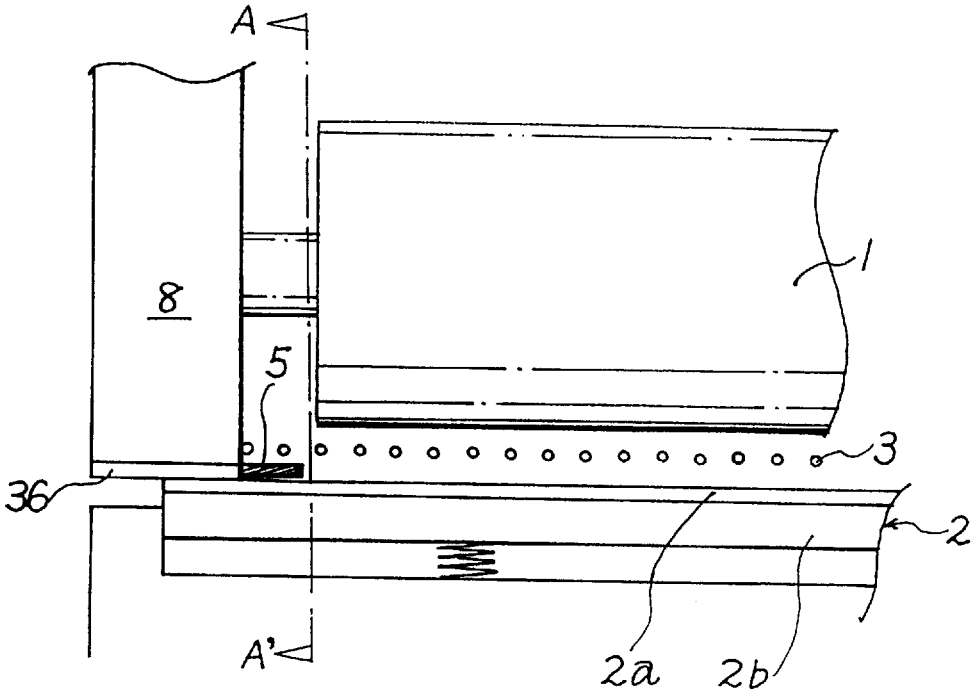

The toner container 8, as shown in FIG. 3, has a dielectric marginal spacer 5 at each longitudinal side end fixed at the bottom thereof, whereby the interval with the control grid 3 is kept accurately, and wherein a guide member 5*a* for the recording paper 4 extends inwardly to cover the marginal area of the control grid 3 where no print is performed.

Figure 4:
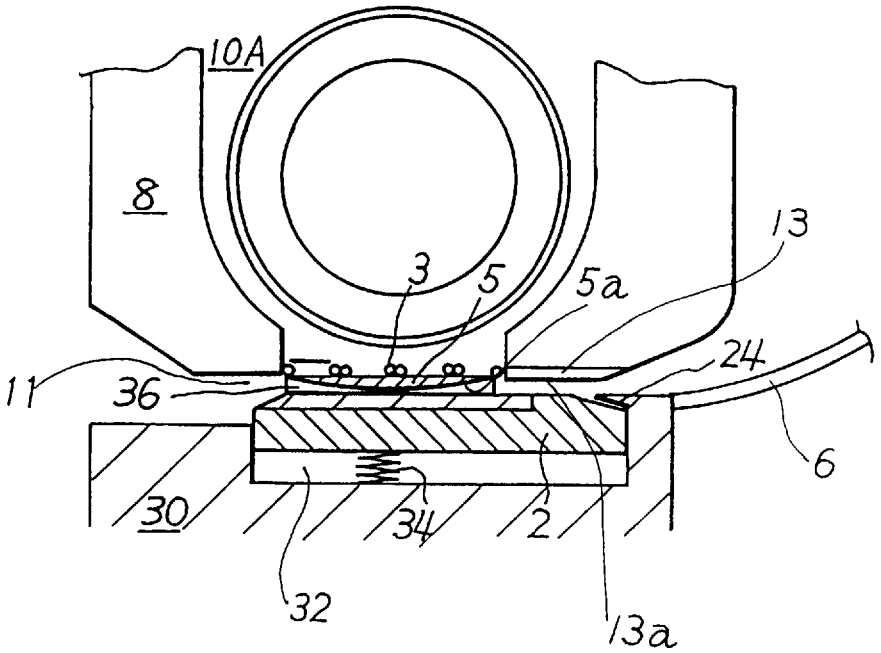

The guide member 5*a*, as shown in FIG. 4, forms its bottom surface convex downward of which surface is applied with fluoro-resin having less frictional surface, forming a tight space between the backing electrode 2, whereby the recording paper 4 is suppressed not to float at the marginal end where no print is performed, and wherein the recording paper 4 is allowed to pass steadily on the surface of the backing electrode 2.

The development roller 1 comprises a development sleeve 1*a* which includes a fixed magnet assembly 1*b*, whereby the toner is triboelectrically charged due to the friction of each other is held with the magnetic force of the magnet assembly 1*b* on the surface of the development sleeve 1*a* to form a toner layer. As the sleeve 1*a* rotates counterclockwise as shown by arrow in FIG. 1, the toner layer is trimmed with the doctor blade 22, and then travels to the opening 21.

The sleeve 1*a* is made of aluminum (nonmagnetic) coated with an insulation layer, or is applied an Alumite surface treatment thereon, and is grounded through a switch 59 to effectable to form a development field in a space between the backing electrode 2 and the sleeve 1*a*.

The control grid 3, as described in the basic technique earlier, comprises a plurality of paired loop wires X1–X2, layers to form FPC—standing for flexible print circuit, wherein a portion surrounded by the paired loop wires on Y-axis and on X-axis forms a toner slot 3*a*.

The backing electrode 2 has a body 2*a* which is formed with a conductive member in a flat strip facing the control grid 3 with a parallel space therebetween, and also has a support member 2*b* to support the body 2*a*, wherein the body 2*a* is connected with a developing voltage generator 39 to form the development field in the space between the toner sleeve 1*a* and the body 2*a*.

The backing electrode 2 rest on the top surface of a support body 30, a part of the apparatus body, through a resilient member 34 which enforces upward thereupon.

In other words, the backing electrode 2 is formed with its body 2*a* in a flat elongated plate made of a conductive member facing to the control grid 3 with a parallel interspace therebetween, wherein the body 2*a* is disposed on the dielectric support member 2*b* elongated axially leveling closely with the top thereof.

On the other hand, the support body 30 provides a square sink 32 in which the backing electrode 2 is vertically movable, of which a top opening edge at the entrance side has a wedged brace 24 with which the backing electrode 2 is effectable to rest in its deadend position.

The backing electrode 2, as shown in FIG. 4, is kept resiliently in its position relative to the unit body 10A through the marginal spacer 5 disposed at each axial bottom end of the toner container 8, wherein the interval between the control grid 3 and thereof is kept accurately.

In the embodiment above, the unit body 10A is effectable to be vertically removable apart, and lodgeable into the backing electrode 2. A buffered lodging of the unit body 10A produces no toner drop from the development roller 1, nor damages the members concerned, because the unit body 10A is lodged through the marginal spacer 5 on the backing electrode 2 enforced resiliently with the resilient member 34 which absorbs shock during joining.

A spacer 13 formed in thin plate like a knife edge is disposed at the bottom and entrance side of the unit body 10A next to the opening 21. The recording paper inserted in the inlet guide 6 into the image forming device 10, is guided suppressedly with the spacer 13, and then accurately into the interspace 11 without any floating, nor meandering. As the spacer 13 orients the recording paper closer to the backing electrode 2, rather than to the control grid 3, the recording paper inserted in the interspace 11 does not accidentally contact with the control grid.

A restriction member 36 disposed at the bottom of the toner container provides the interspace 11 with an interval slightly narrower than the thickness of the recording paper 4. The restriction member 36 projects the marginal spacer 5 which suppresses the marginal area of the recording paper 4 toward the backing electrode 2 supported variably in its height with the resilient member 34. The thickness variation of the recording paper 4 traveling in the interspace 11 is absorbed with the height variation of the backing electrode 2 supported resiliently. Thus, the recording paper 4 inserted in the interspace 11 formed with the restriction member 36 travels steadily on the surface of the backing electrode 2 without any floating nor meandering due to the restriction and suppression action of the members 36, 5, and further, with the constant interval of the interspace 11 between the control grid 3 and the surface of the recording paper 4 of which variation is absorbed with the resiliently supported backing electrode 2.

Figure 5:
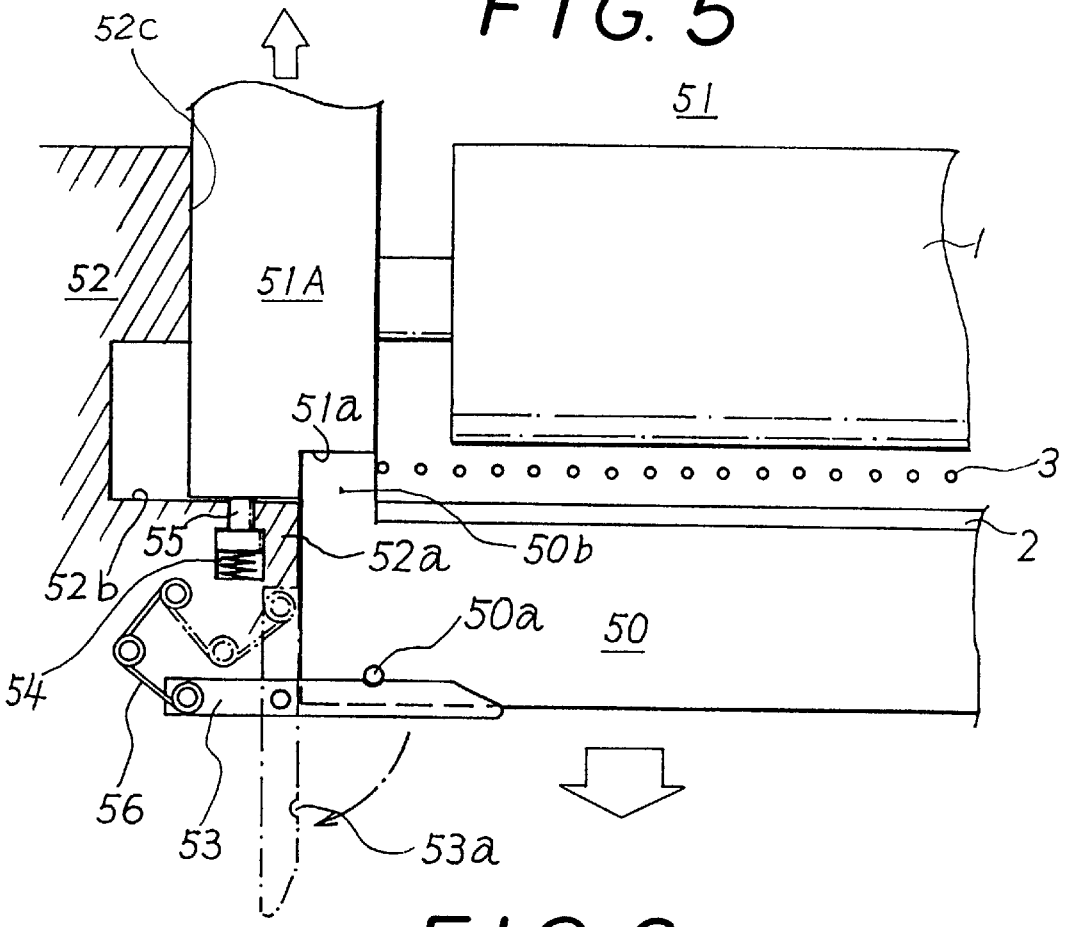

In FIG. 5, there is illustrated another embodiment showing a unit body 50 which associates the backing electrode 2 and the control grid 3. The unit body 50 is removable downward along a support member 53 in its release position disposed on a vertical wall 52*a* of an apparatus body 52. A development unit 51 facing to the unit body 50, on the other hand, comprises the development roller 1 axially and rotatably supported in the toner container 51A, which is formed lodgeably on the horizontal bed 52*b* of the apparatus body 52, and which is removable upward along the vertical wall 52*c* from the horizontal bed 52*b*.

Further to the above, the unit body 50 is provided in mid portion a square sink on the top facing to the development roller 1, at the bottom of the sink the backing electrode 2, and on the top of the sink the meshed control grid 3 with a interspace therebetween.

The apparatus body 52 comprises the vertical wall 52*a* for guiding the unit body 50, which is formed in bending downward the end of the horizontal bed 52*b*, a vertical wall 52*c* which is formed in standing upward from the horizontal bed 52*b* with a square sink thereon, The horizontal bed 52*b* positioning the toner container 51A is provided inside thereof with a projection member 55 enforced by a resilient member 54.

There is provided in pivotally engagement therewith the support member 53 below the horizontal bed 52*b*, of which one of the side surface corresponds to the vertical wall 52*a* in its release position, and a paperclip spring 56 at an opposite end, wherein the support member 53 is turnable downward to the release position and projectively to a support position, and is maintainable each position enforced by the spring action of the paper clip spring 56.

The development unit 51 is formed to have a square sink 51*a* at the bottom edge of a side frame 51A of which side surface corresponds to the vertical wall 52*a*, wherein the sink 51*a* is effectable to receive intimately a projection 50b of the unit body 50 inserted upward along the vertical wall 52*a*. The unit body 50 is inserted into the apparatus body 52 during which the support member 53 is kept vertical in the release position, and then the support member 53 is flipped horizontally to the support position mating a pin 50*a* with a nick 53*a*. The reverse steps are subjected to remove the unit body 50 from the apparatus.

In the constitution of the unit body 50 and the development unit 51 above, the development unit or toner container 51 is lodged on the horizontal bed 52*b* of the apparatus body 52 through a cushion consisted of the resilient and projection members 54, 55, whereat the unit body 50 mates suitably without play to fit accurately the control grid 3 of the unit 50 with the development roller 1 with a desired interspace therebetween.

Figure 6:
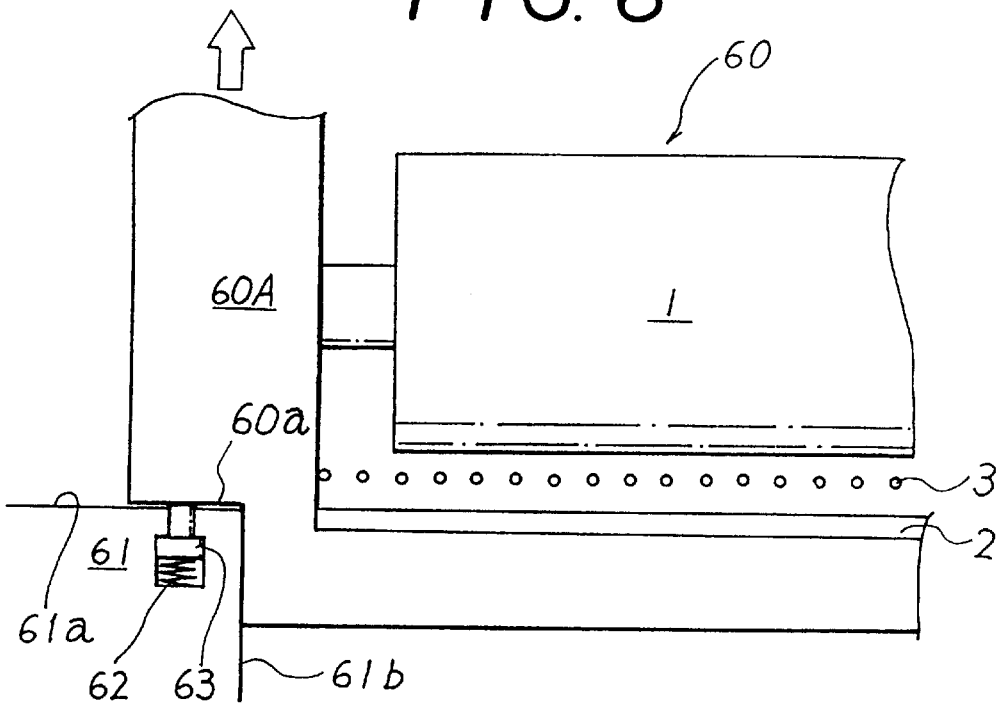
Figure 7:
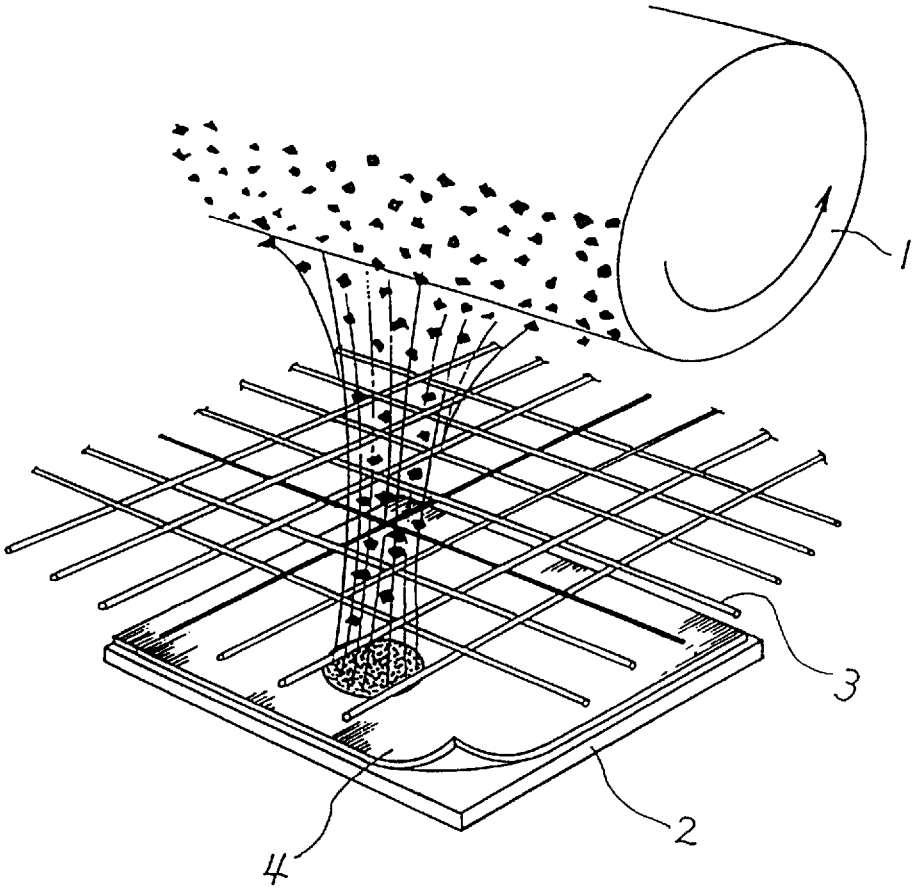
FIG. 7 Prior art
Figure 8:
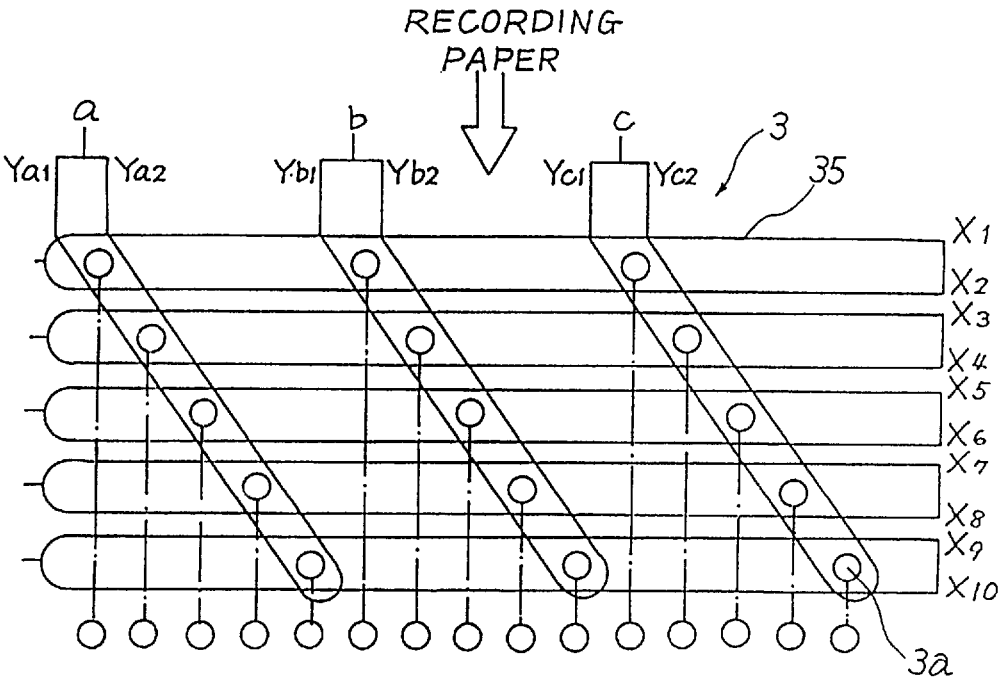
Figure 8:
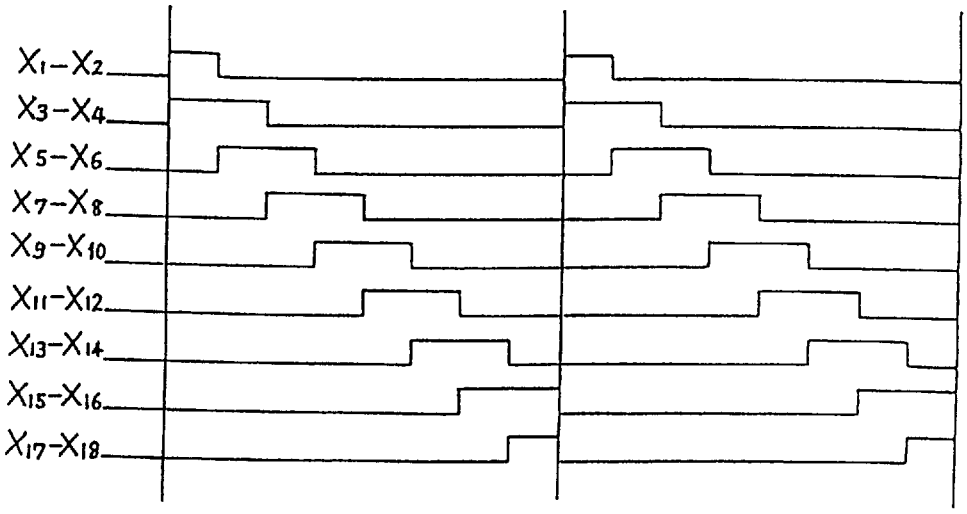

A drawing in FIG. 6, shows another embodiment of the present invention in which a unit body 60 associates the development roller 1, the control grid 3, and the backing electrode 2 therewithal. An apparatus body 61 is provided with a horizontal bed 61*a* for receiving the unit body 61, and a vertical wall 61*b* at each end thereof to confine the span of the unit body 60. Similar to the previous embodiment, there is provided a projection member 63 above the top of the bed 61*a* enforced upward with a coil spring 62 thereupon. The outer edge of the unit body has a sink 60*a* to accept the apparatus 61.

The constitution above enables the unit body 60 to be mounted on the apparatus without a failure to drop toner, because of the cushion of the coil spring 32 and the projection member 63.

The advantages of the embodiments of the unit body 10A, 50, and 60 each of which effectively associates members among the toner carrier, the control grid and the backing electrode are obvious to prove such features as to prevent toner stains, to avoid jamming of paper, to offer an easy maintenance, more especially to save frequent replacements of control grid, to adopt a coloring, and so forth.

What is claimed is:

1. An apparatus for forming an image, said apparatus comprising: a toner carrier for carrying a quantity of toner; a backing electrode including a recording sheet bearing surface facing the toner carrier toner passage control means for controlling passage of toner, said toner passage control means being disposed between the toner carrier; and the backing electrode, said toner passage control means including a plurality of arrayed toner slots which are electromagnetically openable for permitting passage of toner and electromagnetically closeable for blocking passage of toner in response to a control potential corresponding to image information applied to said toner passage control means during movement of a recording sheet having a predetermined thickness on the recording sheet bearing surface of the backing electrode thereby transferring toner carried on the toner carrier to the recording sheet through the toner slots;

spacer means provided between said toner passage control means and said backing electrode for defining a predetermined parallel interspace between said toner passage control means and the recording sheet bearing surface of said backing electrode; and entrance means provided outside said parallel interspace and adjacent to said toner passage control means for guiding the recording sheet into the parallel interspace, said entrance means including a lower guide surface which is substantially even with the recording sheet bearing surface of said backing electrode and an upper guide surface opposing to the lower guide surface, said lower guide surface and said upper guide surface together defining an inlet interspace narrower than said predetermined parallel interspace and wider than the predetermined thickness of the recording sheet.

2. Apparatus as claimed in claim 1, wherein said entrance means is formed of dielectric material.

3. An apparatus as claimed in claim 1 further comprising a guide member provided within the parallel interspace for guiding the recording sheet away from said toner passage control means and pressing the recording sheet against the recording sheet bearing surface of said backing electrode; and means coupled to said backing electrode for resiliently coupling said backing electrode to said guide member.

4. An apparatus as claimed in claim 3, wherein said recording sheet bearing surface of the backing electrode is formed of a conductive material.

5. An image forming apparatus in accordance with claim 1 wherein said upper guide surface is fixed with respect to said lower guide surface.

6. An apparatus for forming an image, said apparatus comprising: an apparatus body; a toner carrier for carrying a quantity of toner; a backing electrode including a recording sheet bearing surface facing the toner carrier; toner passage control means for controlling passage of toner said toner passage control means being disposed between the toner carrier and the backing electrode, said toner passage control means including a plurality of arrayed toner slots, and means for applying a control potential in response to image information applied to said toner passage control means to thereby control the transfer of toner carried on the toner carrier to a recording sheet through the toner slots;

a unit body incorporating therein at least the toner passage control means and one of the toner carrier and the backing electrode;

spacer means provided on the unit body for providing a parallel interspace between the toner passage control means and one of the toner carrier and the backing electrode, the interspace defining a path of travel of the recording sheet; and a guide member provided on the apparatus body for guiding the unit body to lodge the unit body into and remove the unit body from the apparatus body along a direction transverse to the path of travel of the recording sheet.

7. Apparatus as claimed in claim 6 further comprising resilient buffer means provided between the unit body and the apparatus body for reducing shock which occurs when the unit body is lodged into the apparatus body.

8. An apparatus for forming an image, said apparatus comprising: a toner carrier for carrying a quantity of toner; a backing electrode including a recording sheet bearing surface facing the toner carrier; toner passage control means for controlling passage of toner, said toner passage control means being disposed between the toner carrier and the backing electrode, said toner passage control means including a plurality of arrayed toner slots which are electromagnetically openable for permitting passage of toner and electromagnetically closeable for blocking passage of toner in response to a control potential corresponding to image information applied to said toner passage control means during movement of a recording sheet having a predetermined thickness on the recording sheet bearing surface of the backing electrode thereby transferring toner carried on the toner carrier to the recording sheet through the toner slots;

spacer means provided between said toner passage control means and said backing electrode for defining a predetermined parallel interspace between said toner passage control means and the recording sheet bearing surface of said backing electrode; and entrance means provided outside said parallel interspace and adjacent to said toner passage control means for guiding the recording sheet into the parallel interspace, said entrance means including a lower guide surface which is substantially even with the recording sheet bearing surface of said backing electrode and an upper guide surface opposing to the lower guide surface, said lower guide surface and said upper guide surface together defining an inlet interspace narrower than said predetermined parallel interspace and wider than the predetermined thickness of the recording sheet;

wherein the recording sheet has marginal areas where no print is performed, and wherein the backing electrode has a top surface, and the entrance means is disposed on a plane substantially even with the top surface of the backing electrode, and the spacer means between the toner passage control means and the backing electrode includes a guide surface for guiding the recording sheet closer to the backing electrode than to the toner passage control means, said guide surface being provided at each of the marginal areas of the recording sheet.

9. An image forming apparatus comprising: a toner carrier carrying a quantity of toner; a backing electrode having a recording sheet bearing surface facing the toner carrier for bearing a recording sheet having a predetermined thickness; toner passage control means for controlling the passage of toner, said toner passage control means being disposed between the toner carrier and the backing electrode for controlling passage of toner, said toner passage control means including a plurality of arrayed toner slots which are electromagnetically openable for permitting passage of toner and electromagnetically closeable for blocking passage of toner in response to a control potential representative of image information applied to said toner passage control means;

spacer means provided between said toner passage control means and said backing electrode for spacing said toner passage control means from the recording sheet bearing surface to define a predetermined parallel interspace therebetween; and entrance means provided outside said parallel interspace and adjacent to said toner passage control means for guiding a recording sheet having a predetermined thickness into the predetermined parallel interspace, said entrance means including a lower guide surface which is substantially even with the recording sheet bearing surface of said backing electrode and an upper guide surface spaced from and opposing the lower guide surface, said lower guide surface and said upper guide surface together defining an inlet interspace which is narrower than said predetermined parallel interspace and wider than the predetermined thickness of the recording sheet.

10. An image forming apparatus in accordance with claim 9 wherein said entrance means includes inlet guide means for directing the recording sheet toward the inlet interspace, with a trailing end of the recording sheet held higher than a leading end of the recording sheet thereby diagonally directing the recording sheet toward the entrance means.

11. An image forming apparatus in accordance with claim 9, wherein the recording sheet has a marginal side area where no printing is performed, and further comprising marginal spacer means provided between the toner passage control means and the backing electrode for resiliently pressing the marginal side area of the recording sheet against the recording sheet bearing surface of the backing electrode.

12. An image forming apparatus in accordance with claim 11 wherein said marginal spacer means comprises a generally convex lower surface provided within said predetermined parallel interspace and adapted to come in contact with the recording sheet, said convex lower surface having a lowest point spaced from the recording sheet bearing surface a distance narrower than the predetermined thickness of the recording sheet.

13. An image forming apparatus in accordance with claim 12 further comprising resilient support means coupled to said backing electrode for resiliently supporting said backing electrode and pushing said backing electrode against the marginal spacer means.

14. An image forming apparatus in accordance with claim 9 further comprising a unit body including said toner carrier and said toner passage control means.

15. An image forming apparatus in accordance with claim 14 further comprising resilient support means for resiliently supporting the unit body with respect to the backing electrode.

16. An image forming apparatus in accordance with claim 9 further comprising a unit body including said toner passage control means and said backing electrode.

17. An image forming apparatus in accordance with claim 9 further comprising a unit body including said toner carrier, said toner passage control means and said backing electrode.

18. An image forming apparatus in accordance with claim 9 wherein said upper guide surface is fixed with respect to said lower guide surface.

19. An apparatus for forming an image, said apparatus comprising: a toner carrier for carrying a quantity of toner; a backing electrode having a generally planar recording sheet bearing surface facing the toner carrier; toner passage control means for controlling passage of toner, said toner passage control means being disposed between the toner carrier and the backing electrode, said toner passage control means including a plurality of arrayed toner slots which are electromagnetically openable for permitting passage of toner and electromagnetically closeable for blocking passage of toner, thereby controllably transferring toner carried on the toner carrier to a recording sheet having a predetermined thickness through the toner slots during movement of the recording sheet along a convey line of the recording sheet on the generally planar recording sheet bearing surface of the backing electrode;

an inlet guide disposed at an entrance of the convey line of the recording sheet for diagonally directing the recording sheet toward the entrance of the convey line with a tail end of the recording sheet held higher than both a leading end of the recording sheet and the generally planar recording sheet bearing surface thereby preventing the recording sheet from being directed toward said toner passage control means and bringing the leading end of the recording sheet in contact with the recording sheet bearing surface of said backing electrode;

spacer means provided between said toner passage control means and said backing electrode for defining a predetermined parallel interspace between said toner passage control means and the recording sheet bearing surface of said backing electrode; and entrance means provided outside and adjacent to said toner passage control means for guiding a recording sheet into the parallel interspace, said entrance means including a lower guide surface which is substantially even with the recording sheet bearing surface of said backing electrode and an upper guide surface opposing to the lower guide surface, said lower guide surface and said upper guide surface together defining an inlet interspace narrower than said predetermined parallel interspace and wider than the predetermined thickness of the recording sheet.

* * * * *